United States Patent [19]

Lindsey

[11] 4,039,141

[45] Aug. 2, 1977

[54] GROUNDING ACCESSORY FOR A BUNDLE CONDUCTOR STRINGING BLOCK

[76] Inventor: Keith E. Lindsey, 110 El Nido, Pasadena, Calif. 91101

[21] Appl. No.: 603,631

[22] Filed: Aug. 11, 1975

[51] Int. Cl.[2] ..... B65H 59/22

[52] U.S. Cl. ..... 254/134.3 PA; 175/55 G; 254/192

[58] Field of Search ..... 254/134.3 PA, 134.3 R, 254/192; 174/55 G

[56] References Cited

U.S. PATENT DOCUMENTS

| | | | |
|---|---|---|---|
| 2,786,092 | 3/1957 | Gage | 254/134.3 PA |
| 3,545,724 | 12/1970 | Wright | 254/134.3 PA |
| 3,565,401 | 2/1971 | Green | 254/134.3 PA |
| 3,720,399 | 3/1973 | Bozeman | 254/134.3 PA |
| 3,844,536 | 10/1974 | Chadwick | 254/134.3 PA |

*Primary Examiner*—Al Lawrence Smith
*Assistant Examiner*—Robert C. Watson
*Attorney, Agent, or Firm*—Sellers and Brace

[57] ABSTRACT

A grounding accessory for detachable assembly to a bundle conductor stringing block and having an independently supported grounding roller resiliently biased against a respective bundle conductor despite different sag conditions while the bundle conductors are being pulled into position along a power line. The separate rollers are pivotally supported for independent bodily movement about an axis of support means forming part of a U-shaped main bracket which bracket is spring biased in a direction to maintain each roller in pressure contact with an individual bundle conductor.

23 Claims, 5 Drawing Figures

GROUNDING ACCESSORY FOR A BUNDLE CONDUCTOR STRINGING BLOCK

This invention relates to bundle conductor stringing blocks, and more particularly to an accessory readily securable astride the sheaves of such a block with provision for resiliently maintaining the individual conductive rollers in contact with a respective bundle conductor while being strung along a power line.

The installation of power line conductors of the bundle conductor type presents problems owing to the presence on those conductors at times of electrical charges. These charges arise from two principal sources, one being the accumulation of static charges of relatively low magnitude and the other being the presence of much higher charges which can be induced if the conductors are being strung closely parallel to an existing operating power line or from accidental contact with a live conductor. The hazard from any of these sources is enhanced if the stringing block employs sheaves equipped with non-conductive liners to avoid risk of scratches and other mechanical damage which commonly and unavoidably occurs if the conductors are strung in direct contact with the metal surfaces of the unlined sheaves.

Proposals have been made heretofore for equipping a single sheaved stringing block with a spring biased grounding roller, but the operating principles of those constructions are not satisfactory if the assembly is expanded to include a separate roller for each sheave of a bundle type stringing block. This is for the reason that the grounding rollers would have a common axis which would permit good contact between the rollers and bundle type conductors only when the same sag angle exists for each conductor. In theory the conductors are being pulled along the power line with equal tension and with the intent to maintain identical sag conditions on the bundle conductors. In practice however, equal sag conditions frequently are not the same with the result that one roller is in firm contact with its conductors whereas another is out of contact or in very poor and unsatisfactory contact with its associated conductors. Typically, it is desirable to maintain a contact pressure of 40–55 lbs; otherwise, provision for grounding charges which can be present is inadequate and unsatisfactory with resultant high risks to the safety of personnel.

One proposal to avoid non-uniform and inadequate contact of the grounding rollers with bundle conductors involves connecting the ends of a common supporting shaft for the rollers to spring-biased arms through a pivot pin loosely socketed in the supporting arms to accommodate articulatory movement. This permits limited but inadequate pivotal movement of the roller supporting shaft and requires all joints between the components of the accessory and the mounting frame of the stringing block to be sufficiently loose to permit a certain degree of universal movement. Such freedom of movement is not conductive to ruggedness or adequate current carrying capacity and results in a structurally weak and inferior assembly as well as a limited ability to compensate for differing sag conditions.

The foregoing and other shortcomings of prior proposals for stringing block grounding facilities are avoided by the present invention utilizing light-weight but rugged components having excellent current carrying capabilities in all relative positions and highly efficient over wide range operating conditions. These results are achieved using a U-shaped bracket comprising a pair of arms firmly and preferably rigidly supporting a common shaft for all grounding rollers. A separate grounding roller for each sheave of the stringing block is mounted on individual brackets independently pivotable about the shaft axis and separately urged into pressurized contact with a conductor by its own torsion spring. Typically, these springs in cooperation with the main energizing springs for the accessory are capable of maintaining each roller in contact with the conductor under 40–55 lbs despite a sag variation between the conductors of 15 degrees. In consequence, conductivity between the rollers and the stringing block main frame is maintained substantially uniform in all positions of the individual rollers. No twisting or strain is placed on the parts since the common support shaft for the rollers remains parallel to the sheave axis at all times.

Accordingly, it is a primary object of this invention to provide an improved, rugged, high efficiency grounding accessory for a bundle conductor stringing block.

Another object of the invention is the provision of a simple, rugged grounding accessory readily attachable to a bundle type stringing block having provision for maintaining the rollers in uniform high pressure contact with the bundle conductors over a wide range of differing sag conditions.

Another object of the invention is the provision of a bundle conductor stringing block equipped with highly effective and reliable means for maintaining separate grounding rollers opposite each sheave in high pressure effective grounding contact with an associated bundle conductor under varying sag conditions.

Another object of the invention is the provision of a grounding roller accessory for a multiple sheave stringing block attachable to and removable from the stringing block as a unit and held in assembled position thereon by a pair of simple fasteners.

These and other more specific objects will appear upon reading the following specification and claims and upon considering in connection therewith the attached drawing to which they relate.

Referring now to the drawing in which a preferred embodiment of the invention is illustrated.

Figure 1:
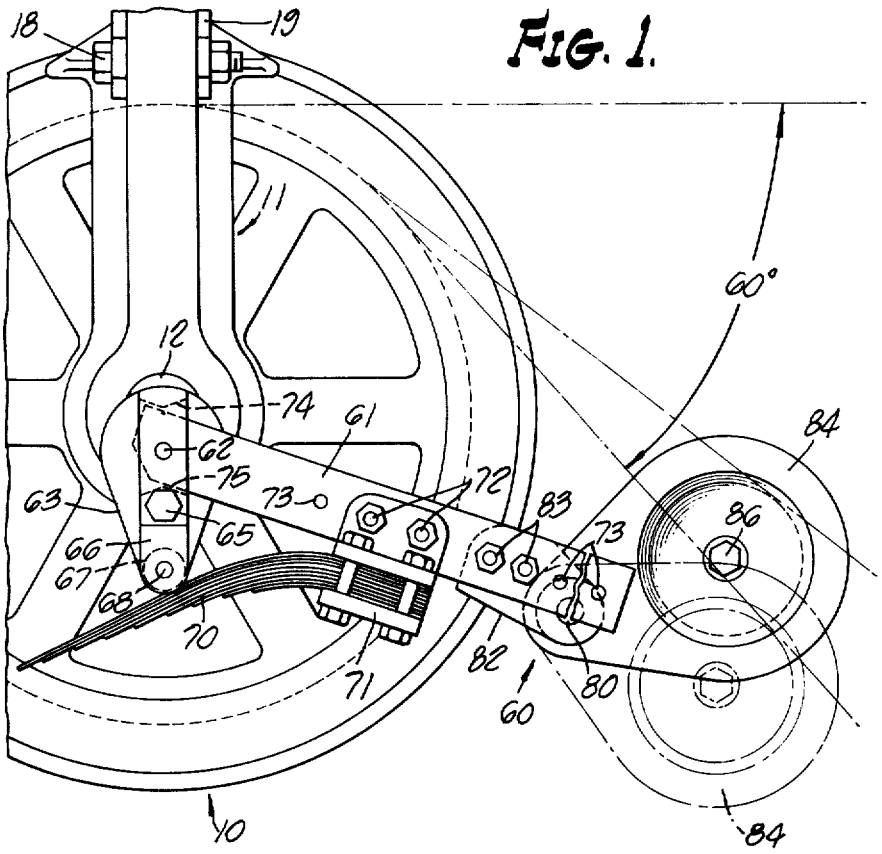
FIG. 1 is a side elevational view of a bundle conductor stringing block with the invention grounding accessory assembled thereto and positioned under more extreme conductor sag conditions.
Figure 2:
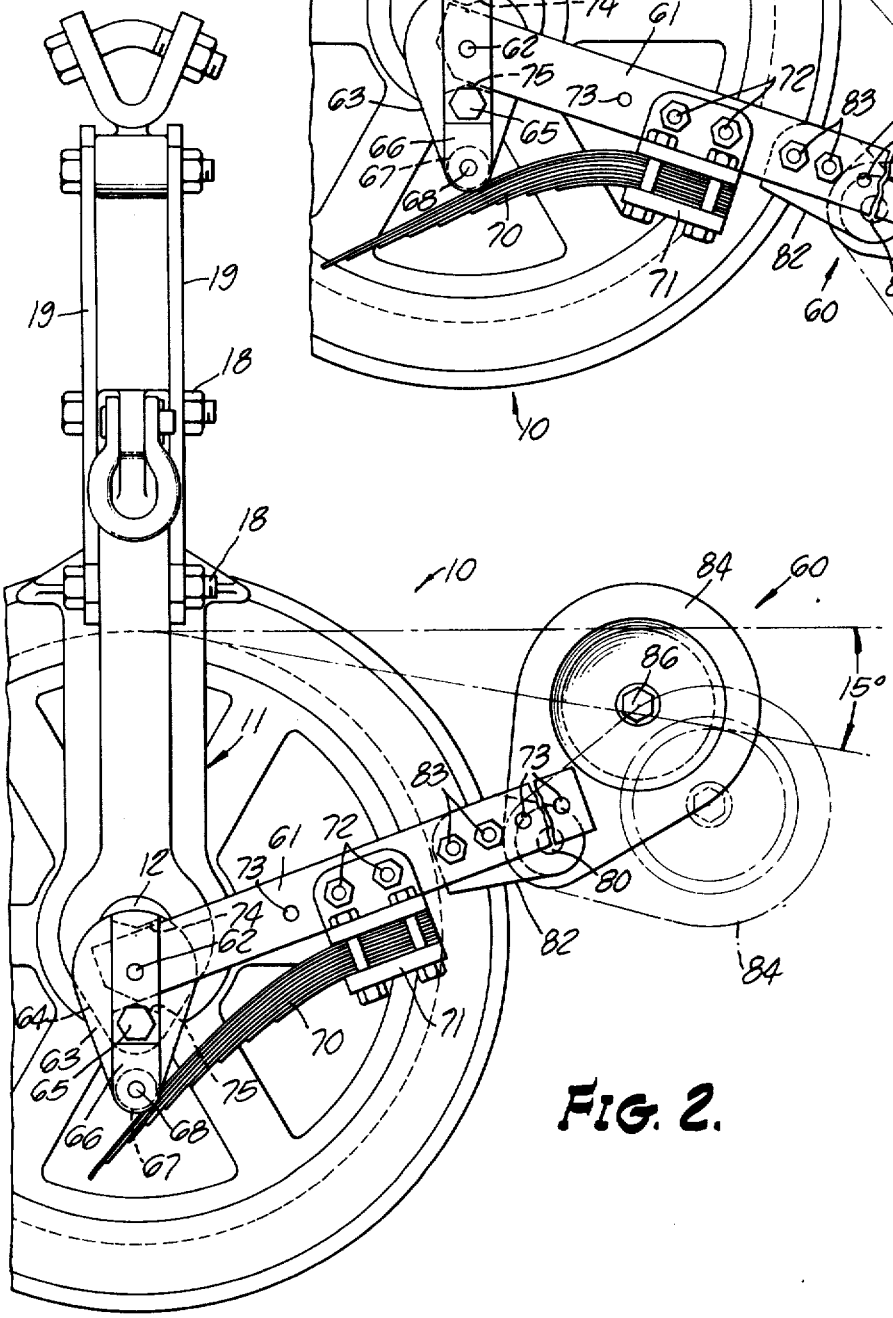
FIG. 2 is a view similar to FIG. 1 but showing the grounding accessory under relatively minor conductor sag conditions.

Referring initially more particularly to FIGS. 1 and 2, there is shown a bundle conductor stringing block designated generally 10. This stringing block has a pair of cast metal side frames 11,11 rigidly interconnected between their lower ends by a horizontal shaft 12. Rotatably supported on shaft 12 are three conductor supporting sheaves 14,15,16 and an intervening sheave or roller 17 normally employed to support the bundle conductor hauling line.

Rigidly clamped to the upper ends of side frames 11,11 by bolts 18 are a pair of coupling adapters 19,19 for use in supporting block 10 by any suitable suspension yoke or a split yoke when the block is to be threaded by helicopter.

Each of the grooves of sheaves 14,15,16,17 are preferably covered with an elastomeric non-conductive layer 55 (FIG. 3) to protect the power conductor against injury while being pulled over the sheaves. Accordingly, it is necessary to provide suitable means for maintaining a continuous high-capacity electrical contact between the conductors and ground to protect personnel from the hazards of electrical charges oftentimes present on the conductors. This objective is accomplished by a unitary grounding accessory, designated generally 60, adapted to be mounted astride the sheaves of the stringing block with the free ends of its legs 61 pivoted on a pin 62 carried by a mounting adapter 63. Each of the two mounting adapters 63 has a recess formed in its inner face seating against the outer face of the adjacent portion of the stringing block side frame 11. As is best shown in FIG. 2, the lower end of each side frame 11 includes an oval shaped lug 64 seating in the recess on the inner face of adapter 63. This lug has an opening seating a clamping bolt 65 cooperating with the internesting surfaces of adapter 63 and lug 64 to hold the grounding accessory 60 rigidly assembled to the stringing block.

Each of the adapters 63 includes a downwardly projecting yoke portion 66 across which a roller 67 is mounted on a pin 68. Bearing against the underside of this roller is the free end of a multi-leaf cantilever spring 70 having its other end rigidly secured in a mounting clamp 71 securable in any selected pair of holes 73 in the leg 61 of the U-shaped bracket by bolts 72. As will be evident from FIGS. 1 and 2, spring 70 urges the grounding accessory to swing counterclockwise about pivot pins 62 until its legs 61 engage an upper stop 74 integral with adapter plate 63 whereas a lower stop 75 limits downward pivotal movement of accessory 60 such as is illustrated in FIG. 1.

The bight portion of the U-shaped grounding accessory 60 comprises a shaft 80 (FIGS. 1–3) having its opposite ends rigidly secured by pins 81 to the tubular leg of a pair of L-shaped brackets 82. The other leg of the bracket 82 is clamped against the face of legs 61 by bolts 83. Legs 61 may be of any suitable length and are provided with a long row of holes 73 accommodating bolts 72 and 83.

Journalled on shaft 80 are separate pairs of brackets each cooperating to support a roller on an axis spaced from but parallel to shaft 80. It will be understood that the brackets and grounding rollers are of generally similar construction and a description of one will suffice for all. Thus the grounding roller sub-assembly disposed in alignment with sheave 14 includes a pair of brackets 84 having the oval shape best shown in FIGS. 1 and 2 with the smaller end journalled on shaft 80. The larger ends of these brackets are held rigidly in spaced apart relation by a spacer sleeve 85 and an assembly bolt 86. Journalled on spacer sleeve 85 is a roller 87 provided with a groove 88 lying in the same plane as the groove of sheave 14.

Brackets 84 and the roller 87 are urged to pivot in a counter-clockwise direction, as viewed in FIGS. 1 and 2, by a torsion spring 89 encircling shaft 80. One end of this spring is anchored to a pin 90 protruding from shaft 80 and its other end is anchored in an opening 91 of one of the brackets 84 in the manner clearly illustrated in FIGS. 3 and 4.

Figures 3, 4, 5:
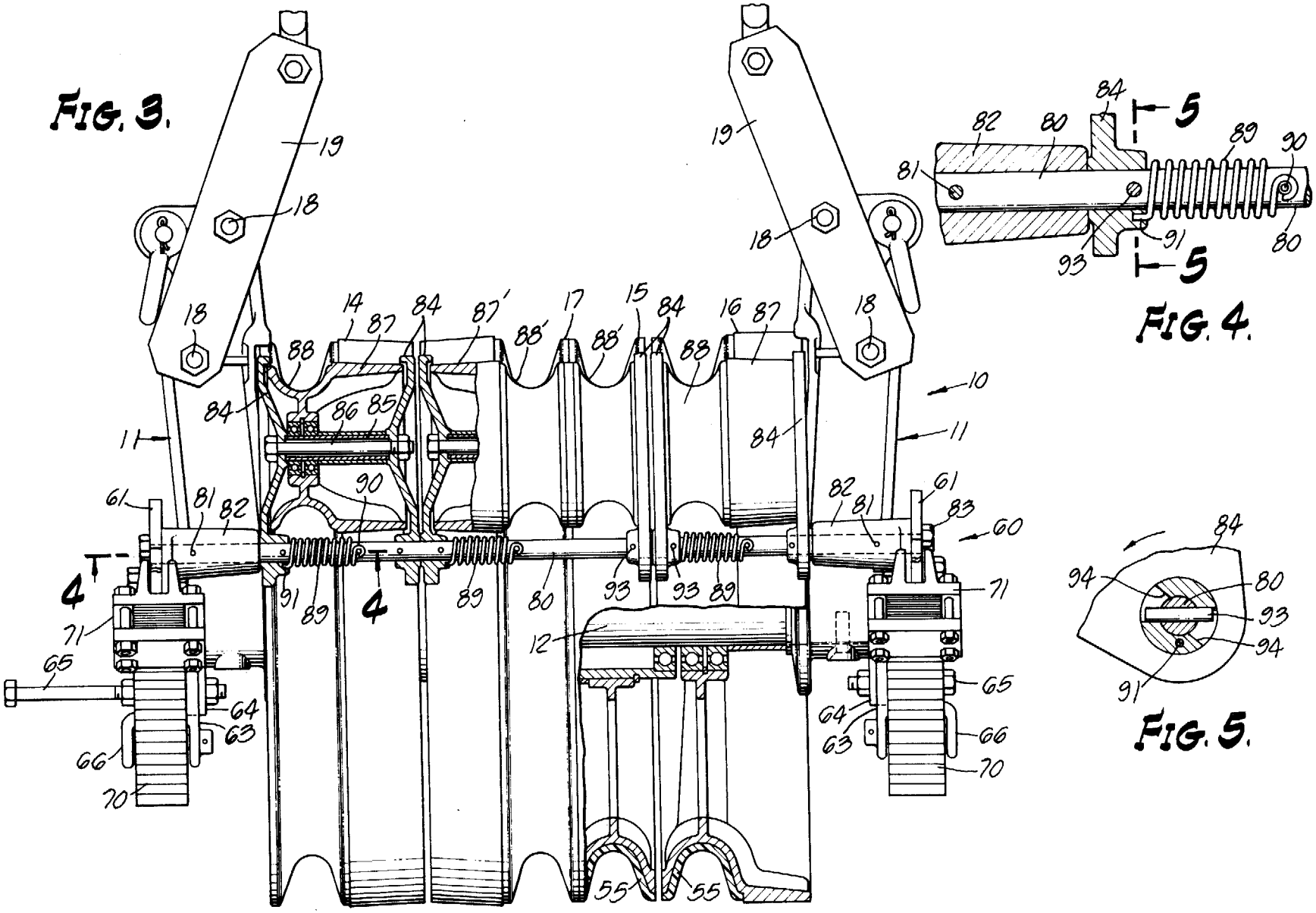
FIG. 3 is a front elevational view of the stringing block as viewed from the right side of FIG. 2 and showing portions in section.
FIG. 4 is a fragmentary cross-sectional view on an enlarged scale taken along line 4—4 on FIG. 3.
FIG. 5 is a cross-sectional view on an enlarged scale taken along line 5—5 on FIG. 4.

The pivotal movement of the grounding roller subassemblies about shaft 80 is limited to a suitable operating arc such as that represented by the full line and the dot and dash line positions of these rollers shown in FIGS. 1 and 2. The means controlling this limited arc of movement is best shown in FIG. 5 as comprising a pin 93 having a frictional fit in an opening through shaft 80 with its opposite ends extending into notches 94 in the adjacent face of the bracket 84. The arcuate extent of notches 94 can be varied as desired to control the permissible pivotal movement of the roller subassemblies about shaft 80.

Each of the other roller subassemblies is identical with that just described with the exception that the center roller 87' is considerably longer and is provided with a pair of seating grooves 88', 88' aligned respectively with the grooves of sheaves 15 and 17.

The operation of a stringing block for bundle conductors equipped with the described grounding accessory 60 will be readily apparent from the foregoing description of the structure and its relationship to the stringing block. Initially and prior to the passage of the bundle conductors into the throat of the stringing block, the cantilever springs 70 and the torsion springs 89 will support accessory 60 in the full line position shown in FIG. 2 with the legs 61 of its U-shaped main frame resting against the upper stops 74 and the individual roller-supporting brackets 84 biased counter-clockwise so that the grooves of the individual rollers are horizontally aligned with the sheave grooves, as clearly appears in FIGS. 2 and 3. As soon as the bundle conductors are passed over the grounding rollers and over the sheaves, the always-present sag in the conductors will load the torsion springs 89 and the leaf spring 70 causing the roller subassemblies to pivot clockwise about shaft 80 and the U-shaped bracket of the grounding accessory 60 to pivot clockwise about its supporting pins 62. FIG. 2 shows only the roller subassemblies pivoted downwardly counterclockwise but, in actual practice and with bundle conductors present, both the roller subassemblies and the U-shaped main bracket 61,80 will both be pivoted downwardly to some extent flexing spring 70 as well as the torsion springs 89. The dot and dash line showing of the roller subassemblies in FIG. 2 represents a conductor sag of about 15° below the horizontal whereas in FIG. 1 the entire grounding assembly including the roller subassemblies is depressed to 60° below the horizontal which is the maximum permitted by the stops 74,94 as herein illustrated. However, it will be understood that stops permitting a greater range of movement may be employed if desired.

It is desirable that the rollers be maintained in contact with a respective one of the bundle conductors with a force ranging between 40 and 55 lbs., irrespective of the angle of conductor sag to assure a reliable and positive electrical contact of excellent current carrying capability. This magnitude of pressure contact with the conductors is maintained substantially constant throughout a sag range of approximately 60°.

All components of the grounding accessory are made of a metal having excellent current carrying characteristics. A heavy duty grounding electrical connector will be understood as suitably secured to one of the bolts 65 holding the grounding accessory mounted on the stringing block. Such a bolt is shown at the left hand end of FIG. 3 but the grounding conductor has been omitted. Since the grounding accessory is clamped direcly to the main frame of the stringing block, it will be apparent that the grounding conductor may be connected to this frame if desired.

To be noted in particular is the fact that each of the grounding roller subassemblies is independently supported on shaft 80 and is therefore free to pivot either clockwise or counterclockwise about this shaft depending upon the angle of sag present in the individual one of the bundle conductors. Thus, one roller subassembly may be in the full line position shown in FIG. 1 whereas an adjacent one of the roller subassemblies 84 may be in the dot and dash line position shown in this same Figure. In either case it will be readily apparent that the leaf springs 70 and the individual ones of the torsion springs 89 will cooperate with one another in maintaining each roller in firm contact with a particular conductor without placing the main frame of accessory 60 under any unusual stress.

It will be understood that the supporting legs 61 of the grounding accessory are preferably sufficiently long to permit use of the accessory on stringing blocks of a wide range of sizes. The row of holes 73 along the legs permit the spring mounting brackets 71 and the mounting brackets for shaft 80 to be mounted at any selected points along the legs thereby to vary the effective spring bias provided by leaf springs 70 as well as to support rollers 84 opposite the peripheries of sheaves of different diameters. The spring bias can also be varied by adding or omitting leaves of springs 70.

It is not necessary that each stringing block be equipped with grounding accessory 60. In this event the accessory need not be attached or, if present, it can be quickly detached simply by removing the two assembly bolts 65,65. It will be understood that the accessory can be mounted astride either lateral side of the sheaves and that no changes or alterations in the stringing block proper are necessary when attaching or detaching the accessory.

While the particular grounding accessory for a bundle conductor stringing block herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. That improvement in a bundle conductor stringing block of the type having a main frame rotatably supporting a set of grooved sheaves in side-by-side relation for rotation about a common axis which comprises: a conductive grounding accessory for maintaining positive electrical contact with each of a plurality of bundle conductors supported by said sheaves, said accessory comprising a U-shaped bracket movably supported on said main frame astride said sheaves with the bight portion thereof positioned adjacent the periphery of said sheaves, a plurality of brackets each pivotally mounted on said bight portion and supporting a grooved roller on the outer ends thereof each aligned with the groove of a respective one of said sheaves, first spring means resiliently biasing said brackets toward an adjacent one of said sheaves, and second spring means for biasing said U-shaped bracket and said rollers in a direction to hold said rollers in pressure contact with a respective one of bundle conductors while being pulled through said stringing block despite variation in the sag of individual ones of said bundle conductors.

2. That improvement defined in claim 1 characterized in that the bight portion of said U-shaped bracket comprises a shaft, and said bracket supporting means for said rollers being mounted on said shaft for pivotal movement in the plane of a respective one of said sheaves.

3. That improvement defined in claim 1 characterized in that said first and second spring means cooperate with one another in maintaining said rollers in contact with a respective conductor under a pressure of the order of 40 to 55 pounds irrespective of different conductor sag conditions.

4. That improvement defined in claim 1 characterized in that said first spring means biasing said roller supporting brackets toward said sheaves comprises separate torsion spring means encircling the bight portion of said U-shaped bracket.

5. That improvement defined in claim 1 characterized in that said first and second spring means are effective in holding said rollers in contact with a respective conductor with a force of about 40 pounds or more over a conductor sag ranging from nearly horizontal to 45° or more below horizontal.

6. That improvement defined in claim 1 characterized in that said biasing means for said grounding rollers and the biasing means for said U-shaped bracket are effective to pivot said rollers and said U-shaped bracket in the same direction about the respective pivots thereof.

7. That improvement defined in claim 1 characterized in that said second spring biasing means for said U-shaped bracket comprises cantilever leaf spring means extending lengthwise of the legs of said U-shaped bracket with one end bearing against means fixed to the main frame of said stringing block and the other end bearing against said U-shaped bracket, and means rigidly securing one of said ends to the adjacent one of said brackets and said means fixed to said main frame.

8. That improvement defined in claim 7 characterized in that said leaf spring means includes a plurality of leaf springs clamped against one another and terminating at different distances from one end of said leaf spring means.

9. That improvement defined in claim 1 characterized in that said bight portion of said U-shaped bracket includes means for securing the same selectively in different positions along the adjacent ends of the legs of said U-shaped bracket thereby to accommodate said grounding accessory for use on stringing blocks equipped with a different size set of grooved sheaves.

10. That improvement defined in claim 1 characterized in the provision of means for varying the effective strength of said second spring means biasing said U-shaped bracket and said rollers into contact with a respective one of bundle conductors with a desired contact pressure dependent on the size of the stringing block with which said grounding accessory is to be used.

11. A grounding accessory adapted to be pivotally mounted astride the side frames of a bundle conductor stringing block, said accessory comprising a rigid U-shaped bracket having a cylindrical bight portion, a plurality of grooved rollers mounted on the outer ends of bracket means journalled on said bight portion and provided with spring means urging said roller supporting brackets to swing through an arc in the same direction and independently of one another about said bight portion, the free ends of the legs of said U-shaped bracket having means for pivotally mounting said grounding accessory to the side frames of a bundle conductor stringing block for bodily swinging movement astride the sheaves thereof with said rollers aligned with and adjacent the periphery of a respective sheave of the stringing block, and spring means having one end attached to each of said legs and the other end adapted to bear against means carried by the side frames of a stringing block when said accessory is installed astride the same and cooperating therewith to urge said accessory to pivot in the same direction as the spring means for said roller supporting brackets thereby to hold said rollers in pressure contact with each conductor of a bundle conductor when said grounding accessory is in use on a bundle conductor stringing block.

12. That improvement defined in claim 11 characterized in that said grounding accessory comprises a unitary sub-assembly adapted to be held assembled to the side frame members of a bundle conductor stringing block by a single pair of removable fasteners.

13. That improvement defined in claim 11 characterized in that said pair of removable fasteners are securable to said side frame members in an area thereof offset from the axis of the sheaves thereof.

14. That improvement defined in claim 11 characterized in that the legs of said U-shaped bracket are rigidly secured to the adjacent end of said cylindrical portion of said U-shaped bracket.

15. A grounding accessory as defined in claim 11 characterized in that the free ends of the legs of said U-shaped bracket are pivotally connected to separate mounting adapters each having a portion thereof mateable with a similarly shaped portion of a stringing block side frame, and fastener means for rigidly clamping said mounting adapters immovably assembled to said side frames.

16. In combination with a bundle conductor stringing block having a plurality of grooved sheaves mounted on a common shaft between a pair of side frames, a conductive grounding assembly pivotally supported astride said stringing block on an axis adjacent and parallel to the axis of said shaft and comprising a U-shaped bracket having a cylindrical bight portion extending crosswise of and spaced outwardly from the peripheries of said sheaves, bracket means supporting separate grounding rollers for arcuate swinging movement about the axis of said cylindrical bight portion and each aligned with a respective one of said sheaves, first spring means biasing each of said rollers to swing into contact with a separate conductor supported by a respective sheave of said stringing block to maintain electrical grounding contact therewith, and second spring means interposed between the legs of said U-shaped bracket and the side frames of said stringing block supplementing said first mentioned spring means in urging said U-shaped bracket and said rollers into firm contact with a respective conductor supported on the sheaves of said stringing block.

17. The combination defined in claim 16 characterized in that said first and second spring means cooperate in maintaining said rollers in contact with a respective conductor with a force of approximately 40 pounds or greater despite widely differing angles of sag of the conductors in contact with said rollers.

18. A grounding accessory adapted to be pivotally mounted astride a bundle conductor stringing block, said accessory having a U-shaped bracket formed by a pair of legs and a shaft extending therebetween and including means for securing the ends of said shaft in different selected positions along a respective one of said legs, means supporting a plurality of conductor grounding rollers on said shaft for swinging movement thereabout through arcs of predetermined length and including separate spring means biasing each of said rollers toward one end of said arcs of movement, means at the end of said legs remote from said shaft for pivotally mounting said grounding accessory to a respective side frame of a bundle conductor stringing block, and spring means on said legs adapted to cooperate with the side frames of a stringing block to urge said grounding accessory to pivot upwardly toward the underside of bundle conductors.

19. A grounding accessory as defined in claim 18 characterized in that spring means on said legs comprise leaf spring means extending lengthwise of said legs and having one end of each thereof clamped to a respective one of said legs.

20. A grounding accessory as defined in claim 19 characterized in the provision of means for securing said leaf spring means in different positions along the length of said legs thereby to vary the effective strength of said leaf spring means in biasing said grounding rollers against conductors.

21. A grounding accessory as defined in claim 19 characterized in that said leaf spring means comprises a stack of leaf springs of different lengths, and the strength of said spring means being adjustable by varying the number of leaves clamped to the legs of said grounding accessory.

22. A grounding accessory for attachment to bundle stringing blocks of a range of sizes, said accessory having a pair of generally parallel legs one end of which is adapted to be pivotally supported beside a respective side frame of a stringing block, spring means attached to said legs and adapted to be operatively connected to a stringing block frame to bias said legs upwardly, shaft means supporting grounding roller means thereon for the respective sheaves of a bundle stringing block, and means for supporting the ends of said shaft means between the other ends of said legs and selectively and non-pivotally in any one of a plurality of different positions spaced different distances from said one end of said legs thereby to accommodate said accessory for use on stringing blocks having sets of sheaves of different diameters.

23. A grounding accessory as defined in claim 22 characterized in the provision of means for varying the effective strength of said spring means thereby to bias said rollers toward the conductors with a desired contact pressure dependent on the size of the stringing block with which said accessory is to be used.

* * * * *